US007780044B2

(12) United States Patent
Leuliet et al.

(10) Patent No.: US 7,780,044 B2
(45) Date of Patent: Aug. 24, 2010

(54) NEEDLE VALVE PUMP FOR DISPENSING LIQUID PRODUCT

(75) Inventors: David Leuliet, Woincourt (FR); Francois Nicolle, Tourville la Chapelle (FR)

(73) Assignee: Rexam Dispensing Systems S.A.S. (FR)

( * ) Notice: Subject to any disclaimer, the term of this patent is extended or adjusted under 35 U.S.C. 154(b) by 266 days.

(21) Appl. No.: 11/942,806

(22) Filed: Nov. 20, 2007

(65) Prior Publication Data

US 2008/0115845 A1 May 22, 2008

Related U.S. Application Data

(63) Continuation of application No. PCT/FR2006/001029, filed on May 9, 2006.

(30) Foreign Application Priority Data

May 20, 2005 (FR) ..... 05 51308

(51) Int. Cl.
*B65D 88/54* (2006.01)

(52) U.S. Cl. ..... 222/321.9; 222/340

(58) Field of Classification Search ..... 222/320, 222/321.1–321.9, 339–340
See application file for complete search history.

(56) References Cited

U.S. PATENT DOCUMENTS 5,092,495 A * 3/1992 Andre ..... 222/341
6,059,151 A * 5/2000 Fuchs ..... 222/321.6
2004/0256414 A1* 12/2004 Graf ..... 222/321.1

FOREIGN PATENT DOCUMENTS

| | | |
|---|---|---|
| EP | 1 127 624 | 8/2001 |
| FR | 2 631 393 | 11/1989 |
| FR | 2 652 389 | 3/1991 |
| FR | 2 694 607 | 2/1994 |

OTHER PUBLICATIONS

International Search Report, Jul. 31, 2006, 2 pages.

* cited by examiner

*Primary Examiner*—Kevin P Shaver
*Assistant Examiner*—Andrew P Bainbridge
(74) *Attorney, Agent, or Firm*—St. Onge Steward Johnston & Reens LLC

(57) ABSTRACT

The invention is a pump for dispensing liquid or semi-liquid product, designed and intended to be used in particular in the pharmaceutical or cosmetic field. The pump has a needle valve and a dispensing head manually movable on a pump housing between an inactive position and a dispensing position. The head includes a first cylinder forming a metering chamber for the pump, which draws in fluid from a container's reservoir by an intake tube and a check valve. A piston sealingly secured to the metering chamber pushes fluid through a passage into a second dosage chamber that is sealed from the dispensing orifice by a biased needle valve that is biased by a spring that is sealingly isolated from the second dosage chamber, the chamber that holds the elastic spring has a conduit that allows a user to test and verify that the second dosage chamber does not leak.

10 Claims, 3 Drawing Sheets

NEEDLE VALVE PUMP FOR DISPENSING LIQUID PRODUCT

CROSS-REFERENCE TO RELATED APPLICATIONS

The present application is a continuation of pending International patent application PCT/FR2006/001029 filed on May 9, 2006 which designates the United States and claims priority from French patent application 0551308 filed on May 20, 2005, the content of which is incorporated herein by reference.

FIELD OF THE INVENTION

The invention concerns a pump for dispensing a liquid or semi-liquid product, designed in particular for sealing a container containing the product to be dispensed.

The pump according to the invention is particularly, but not exclusively, designed to be used in the pharmaceutical field.

The pump according to the invention is of the so-called "needle-valve" type, which is to say comprising at the top a needle mounted so as to move freely between a closed position in which it blocks the end opening of the pump, and prevents the dispensing of the product, and an open position in which it allows the liquid to pass through said end opening.

BACKGROUND OF THE INVENTION

Such pumps already exist which, in a standard manner, comprise a first cylinder forming a pump chamber, which communicates with an intake tube by means of a check valve, and in which a hollow piston is slidingly mounted. They also comprise a second cylinder, which communicates with the first cylinder, and in which a second piston formed by a needle valve is slidingly mounted, capable of interrupting the communication between the first cylinder and a dispensing nozzle. They finally comprise elastic means, such as a compression spring, which act on the needle valve tending to maintain the latter in a blocking position in which said communication is interrupted.

Such pumps have the following operating principle: when the first piston is moved, the liquid located in the first cylinder is forced into the second cylinder, in which the pressure increases. The second piston tends to push into its cylinder, compressing the spring. When the pressure of the liquid reaches a high enough value to balance this action, the second piston moves, driving the valve linked to it, so that the cylinders are placed in communication with the dispensing nozzle.

Such pumps do not comply with the present demands of quality standards since, for example, the liquid product can be polluted through contact with the metal spring that returns the needle valve to blocking position after dispensing the liquid product.

Furthermore, the doses of liquid product dispensed are often inaccurate, which limits the use of these pumps to the dispensing of certain products.

Moreover, the designs of these pumps do not allow the pump to be produced in several models capable of dispensing the product with different dose sizes. In fact, the volume of the chamber cannot be changed without changing the dimensions of the pump. Thus, it is necessary to provide specific packaging for each size of pump, which considerably increases the production costs.

SUMMARY OF THE INVENTION

The invention aims to solve these disadvantages.

It relates to a pump for dispensing a liquid or semi-liquid product, designed to be used, in particular in the pharmaceutical or cosmetic field. The pump comprises needle valve made up of a base topped by a rod, and a dispensing head manually movable on a pump body between an inactive position and a punctual product-dispensing position. The head comprises:

- a first cylinder forming a dosage chamber of the pump, which communicates with an intake tube by means of a check valve, a piston being slidingly mounted in the first cylinder;
- a second cylinder in which the needle valve is slidingly mounted, said needle valve forming an exhaust valve;
- elastic means for returning the needle to the orifice blocking position.

According to the invention, the dispensing head comprises means for allowing the liquid to pass between the dosage chamber and a second chamber provided at the end of the dispensing head, without the liquid being in contact with the return means. Furthermore, the second cylinder comprises a compartment in which the elastic return means are housed, which is isolated from the second chamber by watertight sealing means, the second chamber communicating with the orifice of the dispensing head.

According to a first embodiment of the pump according to the invention, the passage means consist of at least one passage channel made at least partially in one wall of the cylinder, one of the ends of the channel opening into the dosage chamber and the other end of the channel opening into the second chamber.

In the context of one embodiment, the pump can be manufactured such as to ensure that the second chamber has a volume equal to one dose of product. However, this embodiment is only one alternative embodiment of the invention. Also, a pump having a volume equal to less than one dose can also correspond to the pump according to the invention.

Moreover, it can be provided for the second chamber to be a chamber for chemical or bacteriological treatment of a dose of product.

According to another alternative embodiment, the return means consist of a compression spring.

The pump according to the invention advantageously comprises means for assembling and centring this return spring in relation to said needle valve.

According to yet another alternative embodiment of the pump according to the invention, the watertight sealing means of the compartment consist of a projecting radial ring on an external wall of a base of the needle valve.

According to yet another alternative embodiment, the pump comprises a conduit for checking the seal between the compartment and the second chamber, the conduit communicating with the cylinder by being made through the wall of the cylinder, and being capable of being connected to pneumatic measurement means.

According to a further alternative embodiment, it comprises a spring for returning the dispensing head to the inactive position.

Advantageously, in the context of the latter embodiment, it is provided for the dispensing head to comprise an inner skirt and an outer skirt, between which the second compression spring is placed, the second cylinder being surrounded by the inner skirt of the dispensing head so that the liquid is not in contact with the second spring.

The chamber has a volume preferably comprised between 30 and 250 μL.

In an advantageous manner, it is also provided for the pump according to the invention to comprise means for support and attachment on a container of a product to be dispensed.

BRIEF DESCRIPTION OF THE DRAWINGS

Further objectives and advantages of the invention will become apparent from the following description made in reference to the appended drawings, wherein.

DETAILED DESCRIPTION OF THE INVENTION

The pump according to the invention as described below is particularly suitable to be used to dispense a liquid or semi-liquid pharmaceutical product in the form of a nose spray.

It should, however, be understood that a pump according to the invention can have different shapes, and that it can apply to fields other than the pharmaceutical field. In addition, the numbers mentioned in the context of this example are not all limiting.

Figure 1:
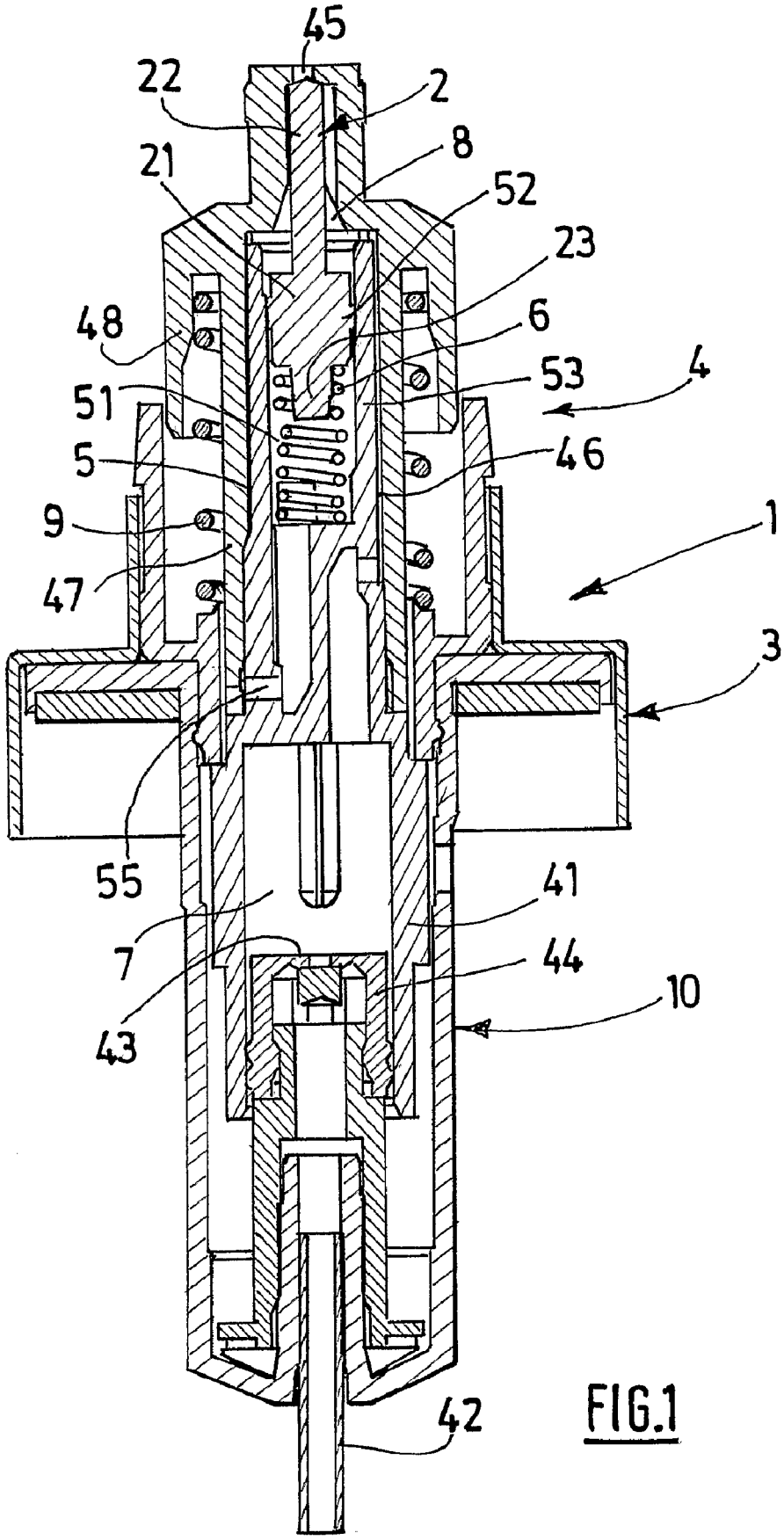
FIG. 1 shows, in a side view, a pump according to a first embodiment of the invention.

Initially, the embodiment of a pump 1 according to the invention is described in reference to FIG. 1. Then, the various steps relating to dispensing a dose of product are described in reference to FIGS. 2 to 7.

As shown in FIG. 1, the pump 1 comprises needle valve 2 made up of a base 21 topped by a rod 22, and a dispensing head 4 manually movable on a pump body 10 between an inactive position and a punctual product-dispensing position.

It also comprises means 3 for support and attachment on a container of a product to be dispensed.

In a standard manner, the head 4 comprises a first cylinder 41 forming a dosage chamber 7 of the pump, which communicates with an intake tube 42 by means of a check valve 43, a piston 44 being slidingly mounted in said first cylinder 41.

The head 4 also comprises a second cylinder 5 in which the needle valve 2, forming an exhaust valve, is slidingly mounted, as well as elastic means 6 for returning the needle valve 2 to a position in which it blocks an orifice 45 through which the product is expelled.

According to the invention, the dispensing head 4 comprises means for allowing the liquid to pass between said dosage chamber 7 and a second chamber 8 provided at the end of the dispensing head 4, without the liquid being in contact with the return means 6.

These passage means consist of at least one passage channel 46 made at least partially in one wall 53 of the cylinder 5 so that one of the ends of the channel 46 opens into the dosage chamber 7 and the other end of the channel opens into the second chamber 8.

Furthermore, the second cylinder 5 comprises a compartment 51 in which the elastic return means 6 are housed and which is isolated from the second chamber 8 by watertight sealing means 52, the second chamber 8 communicating with the orifice 45 of the dispensing head 4.

In the context of this embodiment, the volume of the second chamber 8 is less than that of the dosage chamber 7.

It is also possible for the second chamber 8 to have a volume equal to one dose of product, and to comprise means for chemical or bacteriological treatment of said dose, for example by contact with agents dispersed in the wall of said chamber. However, in order to facilitate the understanding of the figures, this embodiment is not shown.

To allow the needle valve 2 to come out of the orifice 45, and thus allow the product to be dispensed, it is provided for the ratio between the section of the dosage chamber 7 and the second chamber 8 to be comprised between 2 and 10. In the context of this embodiment (shown in FIG. 1) the ratio is 8.

As can be seen in FIG. 1, the means for returning the needle valve to the position in which it blocks the orifice 45 consist of a compression spring 6.

According to advantageous characteristics, the pump described here comprises means for assembling and centring the return spring 6 in relation to the needle valve 2.

In view of FIG. 1, it is understood that these assembly and centring means consist of a lug 23 projecting from the base 21, around which the spring 6 is engaged.

Furthermore, the watertight sealing means of said compartment 51 are formed by a projecting radial ring 52 on an external wall of the base 21 of the needle valve 2.

The pump 1 according to the invention as shown in the appended figures comprises a conduit 55 for checking the seal between the compartment 51 and the second chamber 8.

The conduit 55 communicates with the compartment 51 by being made through the wall of the cylinder 5 and being capable of being connected to pneumatic measurement means.

These pneumatic measurement means can be, for example, a pressure gauge, checking the internal pressure within the compartment 51: if the seal between the compartment 51 and the chamber 8 is not perfect, an air leak can appear between the ring 52 and the inner face of the wall 53. This air leak can be detected by the pressure gauge, which then indicates a pressure drop.

Figure 4:
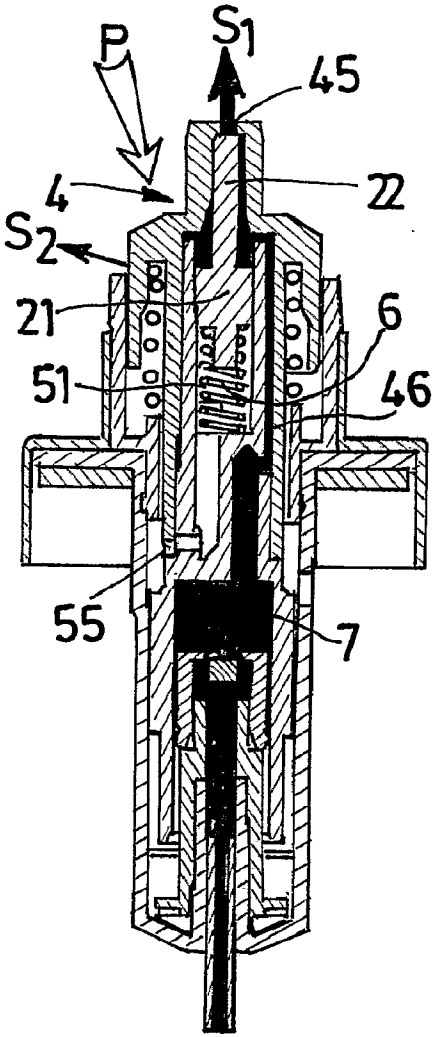
FIGS. 2 to 7 show, in a section view, the pump depicted in FIG. 1 in different steps of activation, as well as the course of the liquid product in said pump in each of these steps.

Furthermore, the conduit 55 has a double function since it allows the release of the air contained in the compartment 51 when the spring 6 is compressed, as shown in FIG. 4 in particular by an outward arrow S2.

In addition, it is provided to equip the pump 1 with a second compression spring 9 guaranteeing the elastic return of the dispensing head 4 to the inactive position.

The dispensing head 4 then comprises an inner skirt 47 and an outer skirt 48 (FIG. 1), between which the second spring is placed.

As shown, the second cylinder 5 is surrounded by the inner skirt 47 of the dispensing head so that the liquid is not in contact with this second spring 9, which could pollute or contaminate it.

The liquid product is normally sprayed in doses with volumes comprised between 30 and 250 μL and this is therefore the range of volumes chosen for the dosage chamber 7.

The actual design of this pump 1 makes it possible to change the volume of the dosage chamber without having to modify the wrapping or packaging of the bottle equipped with this pump.

In fact, in relation to FIG. 1, it can be easily understood that it suffices merely to change the length of the pump body 10 which encloses the cylinder 41 containing the dosage chamber 7. Since the pump body is enclosed within the bottle (or container) containing the product, it is not necessary to change the dimensions of the top of the dispensing head 4. In other words, the part of the pump that tops the means 3 for supporting and attaching it to the container, or bottle, of the product to be dispensed, does not change size and always has the same bulk.

The pump 1 according to the invention depicted in FIG. 1 having been entirely described, the various steps of spraying a dose of product are presented below in reference to FIGS. 2 to 7.

FIGS. 2 to 7 show the pump 1 in a section view at different stages of spraying a dose of liquid product, between the moment when the user begins to press the dispensing head 4 and the moment when the dispensing head 4 returns to its inactive position.

Figure 2:
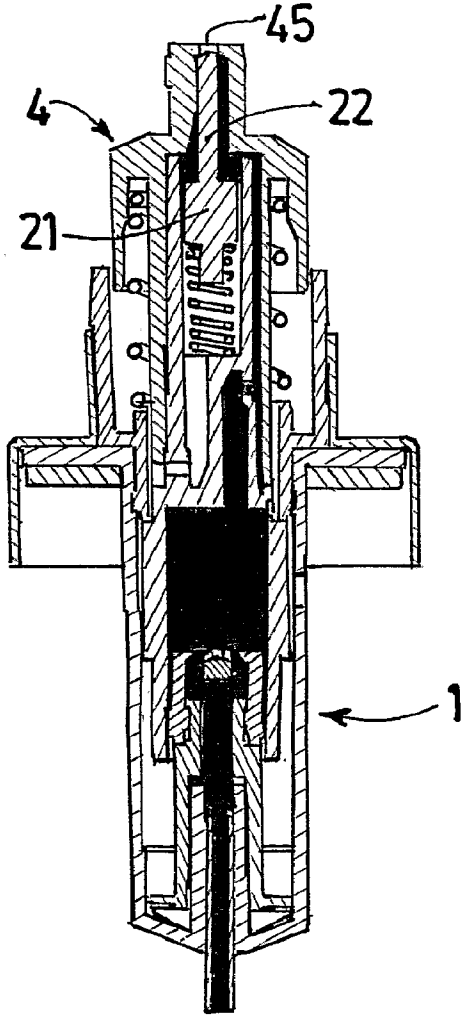

FIG. 2 shows the pump 1 in its initial state, before dispensing a dose of product, and after being primed, which is to say, after having been pressed several times in order to release the air contained in the dosage chamber and replace it with a dose of product to be dispensed.

Figure 7:
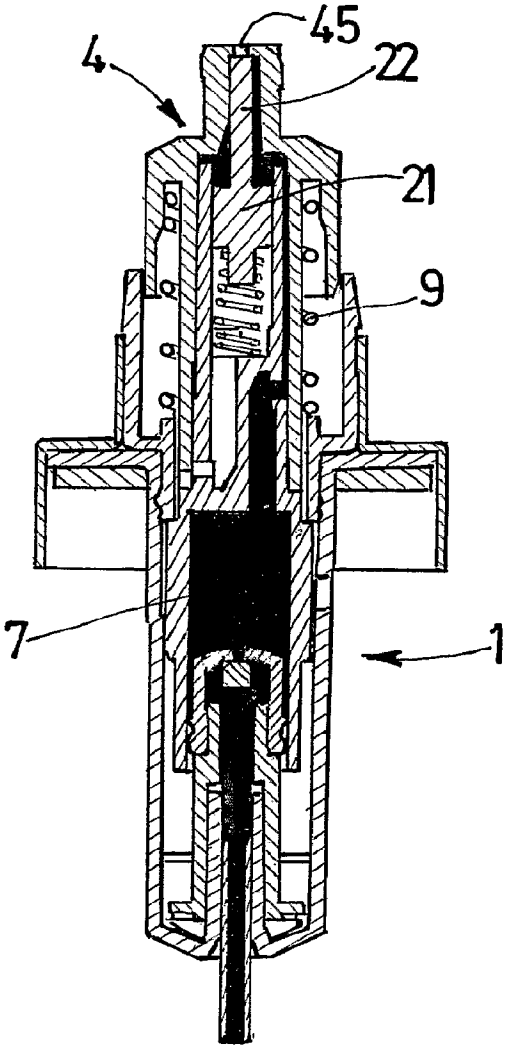

FIG. 7 shows the pump 1 in its final state, after dispensing a dose of product.

It can be seen that the pump 1 shown in FIG. 2 is identical to that in FIG. 7. Also, therefore, it is understood that the pump can be activated again to dispense a second dose of product as soon as the spraying head returns to its initial position.

Figure 3:
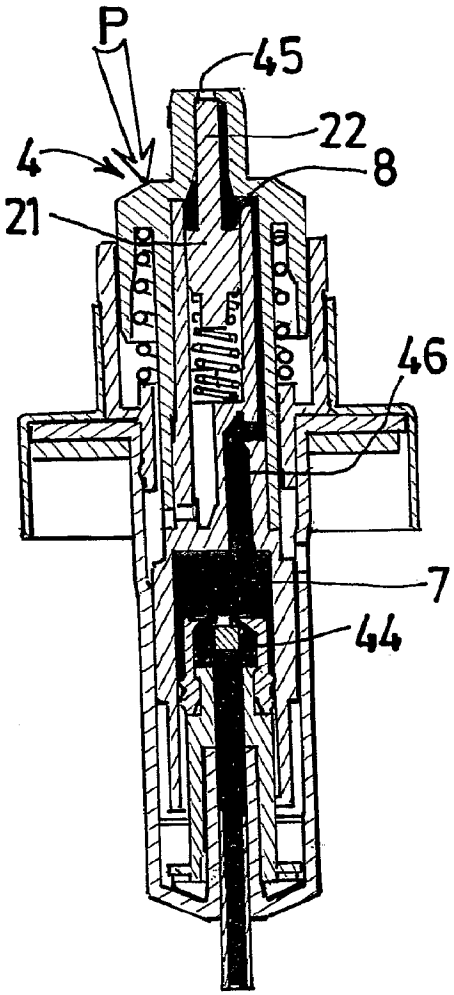

FIG. 3 shows the pump 1 at the moment when the user begins to exert pressure P (depicted by an arrow in FIG. 3) on the dispensing head 4.

Under the action of this pressure P, the piston 44 compresses the product contained in the dosage chamber 7.

The product compressed in the dosage chamber 7 then in turn exerts a pressure on the liquid contained in the passage 46, and indirectly on the liquid product contained in the second chamber 8.

As can be understood from FIG. 4, the pressure exerted on the liquid product contained in the second chamber 8 in turn exerts a pressure on the base 21 of the needle valve 2.

Also, under the effect of this pressure, the base 21 of the needle valve 2 compresses the spring 6 in the compartment 51.

The base 21 of the needle valve being solidly attached to the rod 22 of the needle valve, the latter moves out of the orifice 45 freeing up a passage through which the liquid product is ejected towards the outside of the pump, as shown by the arrow S1.

At the same time, due to the presence of sealing means 52/54 between the compartment 51 and the second chamber 8, the air contained within the compartment 52 is pushed into the conduit 55, penetrating the space comprised between the inner skirt 47 and the outer skirt 48 of the dispensing head, and is expelled out of the pump following the arrow S2.

Figure 5:
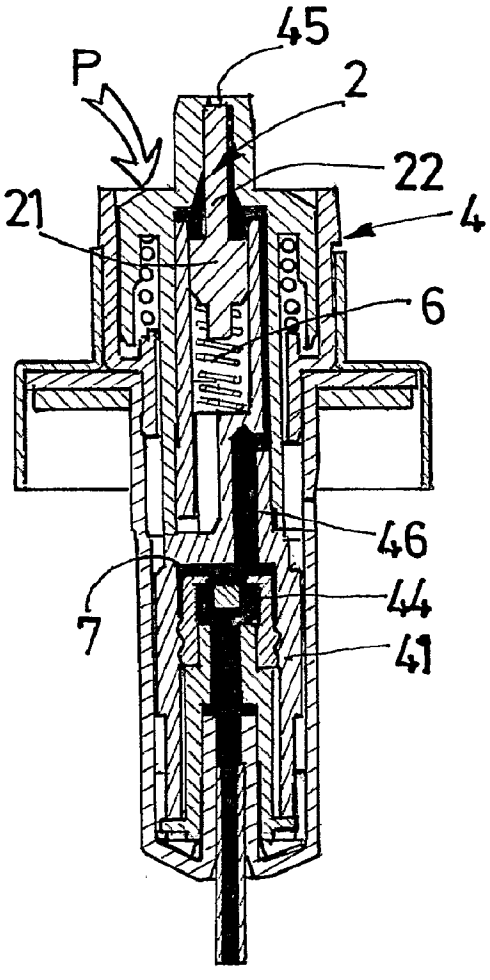

FIG. 5 shows the pump 1 with its dispensing head 4 pushed in as far as possible by the user, until its bottom end position.

When the dispensing head 4 is in its bottom end position, the piston 44 is in its top end position in the first cylinder 41, and the dosage chamber 7 is penetrated by the end of the piston 44.

Also, at the moment when the head 4 is located in its bottom position, the piston 44 ceases to exert pressure on the liquid contained in the chamber or in the passage 46.

In addition, the liquid product contained in the second chamber 8 ceases to exert pressure on the base 21 of the needle valve 2.

Also, the compression spring 6 extends and causes the needle valve 2 to rise up until the end of the rod 22 blocks the orifice 45 of the dispensing head 4. The dispensing of the dose of liquid ends in this way.

Figure 6:
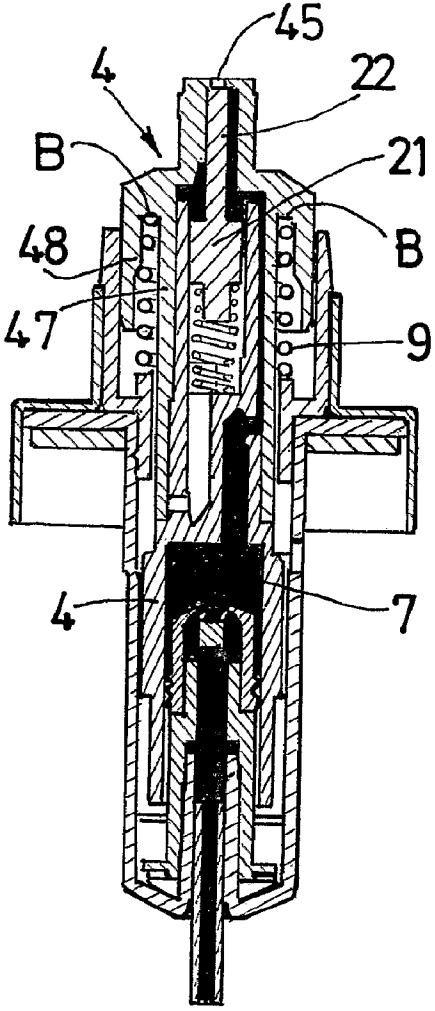

When the user stops exerting pressure on the dispensing head 4, as shown in FIG. 6, the compression spring 9 tends to cause the dispensing head 4 to rise back up, exerting a pressure on B, between the inner skirt of the spraying head.

The dispensing head 4, solidly attached to the cylinder 41 comprising the dosage chamber, drives the cylinder 41 raising it up to its initial position.

A depression is thus created in the dosage chamber 7, which then sucks in the liquid product contained in the intake tube 42.

The dispensing head continues to rise under the action of the spring 9 until it reaches the initial top position shown in FIG. 7, and the dosage chamber 7 continues to fill under the effect of the depression created in the chamber (suction phenomenon).

Once the dispensing head 4 reaches its top position, the pump 1 can then be activated again by the user to dispense a new dose of the product.

The preceding description discloses the specific characteristics of the pump, allowing the product never to be in contact with contaminating agents, in particular relating to the elastic means for returning the needle valve to the blocking position, and to the elastic return means of the dispensing head.

Also, it is understood how the pump 1 according to the invention is designed to limit the expense involved in wrapping and packing the bottle on which it is mounted.

It should, however, be understood that the pump according to the invention is not limited to the above description, shown in FIGS. 1 to 7, and that, on the contrary, it extends to all alternative embodiments that fulfil the main characteristics of the same.

What is claimed is:

1. A pump for dispensing a liquid or semi-liquid product, designed to be used, in particular, in the pharmaceutical or cosmetic field, said pump comprising a needle valve made up of a base topped by a rod, and a dispensing head manually movable on a pump body between an inactive position and a punctual product-dispensing position, said head comprising:

a first cylinder forming a dosage chamber of the pump, which communicates with an intake tube by means of a check valve, a piston being slidingly mounted in said first cylinder;

a second cylinder in which said needle valve is slidingly mounted, forming an exhaust valve;

elastic means for respectively returning said needle valve to the position in which it blocks an orifice and the dispensing head to the inactive position;

wherein said dispensing head comprises means for allowing the liquid to pass between said dosage chamber and a second chamber provided at the end of the dispensing head and communicating with the orifice of the dispensing head, said second cylinder comprising a compartment in which said elastic return means of the needle valve are housed and which is isolated from said second chamber by a watertight sealing means and in that said dispensing head comprises an inner skirt surrounding said second cylinder and an outer skirt, between which said return means of the head are placed, so that said liquid is not in contact with said return means; and wherein the pump comprises a conduit in communication with said compartment on the elastic return means side of the watertight sealing means.

2. The pump according to claim 1, characterised in that said passage means consist of at least one passage channel made at least partially in one wall of the cylinder, one of the ends of said channel opening into said dosage chamber and the other end of the channel opening into the second chamber.

3. The pump according to claim 1, characterised in that said second chamber has a volume equal to one dose of product.

4. The pump according to claim 1, characterised in that said second chamber is a chamber for chemical or biological treatment of a dose of product.

5. The pump according claim 1, characterised in that the return means consist of a compression spring.

6. The pump according to claim 5, characterised in that it comprises means for assembling and centering said return spring in relation to said needle valve.

7. The pump according to claim 1, characterised in that said watertight sealing means of said compartment are formed by a projecting radial ring on an external wall of the base of the needle valve.

8. Pump according to claim 1, wherein the conduit is selectively connected to a pneumatic measurement means for checking the seal between said compartment and said second chamber.

9. The pump according to claim 1, characterised in that said chamber has a volume comprised between 30 and 250 μl.

10. The pump according to claim 1, characterised in that it comprises means for support and attachment on a container of a product to be dispensed.

* * * * *